United States Patent [19]

McDonie

[11] 4,331,701

[45] May 25, 1982

[54] RUBIDIUM-CESIUM-ANTIMONY PHOTOCATHODE

[75] Inventor: Arthur F. McDonie, Lancaster, Pa.

[73] Assignee: RCA Corporation, New York, N.Y.

[21] Appl. No.: 229,296

[22] Filed: Jan. 28, 1981

Related U.S. Application Data

[62] Division of Ser. No. 937,567, Aug. 28, 1978, abandoned.

[51] Int. Cl.[3] ..... B05D 1/34; B05D 1/38; B05D 3/04

[52] U.S. Cl. ..... 427/10; 148/63; 427/74

[58] Field of Search ..... 427/10, 74; 148/6.3

[56] References Cited

U.S. PATENT DOCUMENTS 3,434,876 3/1969 Stoudenheimer et al. ..... 427/10 X
4,039,887 8/1977 McDonie ..... 427/74 X

OTHER PUBLICATIONS

Morrison, "Technique for Producing High-Sensitivity Rubidium-Cesium-Antimony Photocathodes" J. Applied Physics, vol. 37, No. 2, pp. 713-715, Feb. 1966.

*Primary Examiner*—James R. Hoffman
*Attorney, Agent, or Firm*—Eugene M. Whitacre; Dennis H. Irlbeck; Vincent J. Coughlin, Jr.

[57] ABSTRACT

A film of either manganese or antimony is evaporated onto a substrate within an evacuated enclosure. Oxygen is introduced into the enclosure to oxidize the film. A layer of antimony is then deposited onto the oxidized film to a predetermined thickness measured by the transmission of light through the substrate. Rubidium and cesium are then evaporated onto the antimony layer after which the substrate is heated to promote an activating reaction between the rubidium, cesium and antimony. Photocathodes formed in this manner, without superficial oxidation, typically have sensitivities within the range of 80-130 microamperes per lumen.

2 Claims, 2 Drawing Figures

RUBIDIUM-CESIUM-ANTIMONY PHOTOCATHODE

This is a division of application Ser. No. 937,567, filed 8-28-78, and now abandoned.

BACKGROUND OF THE INVENTION

1. Field of the Invention

This invention relates to a photocathode and more particularly to a photocathode comprising rubidium, cesium and antimony, and to methods of forming such a photocathode.

2. Description of the Prior Art

The rubidium-cesium-antimony (Rb-Cs-Sb) photocathode, useful in phototubes and other high vacuum photomultiplier tubes, has been known for some time. The particular advantages of this photocathode over the commonly used S-11 (Cs-Sb), ($K_2CsSb$) and ($Na_2KSb$) photocathodes have been found to be in its better properties of long wavelength threshold, luminous sensitivity and relative ease of processing. (See Carl W. Morrison, "Technique For Producing High Sensitivity Rubidium-Cesium-Antimony Photocathodes", Journal of Applied Physics, Volume 37, Number 2, February 1966, pages 713–715.)

It has also been determined that the sensitivity and threshold wavelength of Rb-Cs-Sb photocathodes are increased by the well-known process of superficial oxidation. However, the sensitivities of these photocathodes produced by the common prior art techniques, including superficial oxidation, disadvantageously vary within a wide range from about 30 to 120 microamperes per lumen. Such a broad range of photocathode sensitivities generally results in unacceptable non-uniformities in tube performance and relatively high scrap rates due to failure to meet required sensitivity levels. It is therefore desirable to consistently make photocathodes of relatively high sensitivity without superficial oxidation for ease of processing and improvement in performance.

SUMMARY OF THE INVENTION

A photocathode comprises a substrate and a film of antimony oxide or manganese oxide on the substrate. A layer of antimony is included on the oxide film and a deposit of rubidium and cesium is on the antimony layer.

A method of forming such a photocathode is also provided.

DETAILED DESCRIPTION OF THE PREFERRED EMBODIMENT

Figure 1:
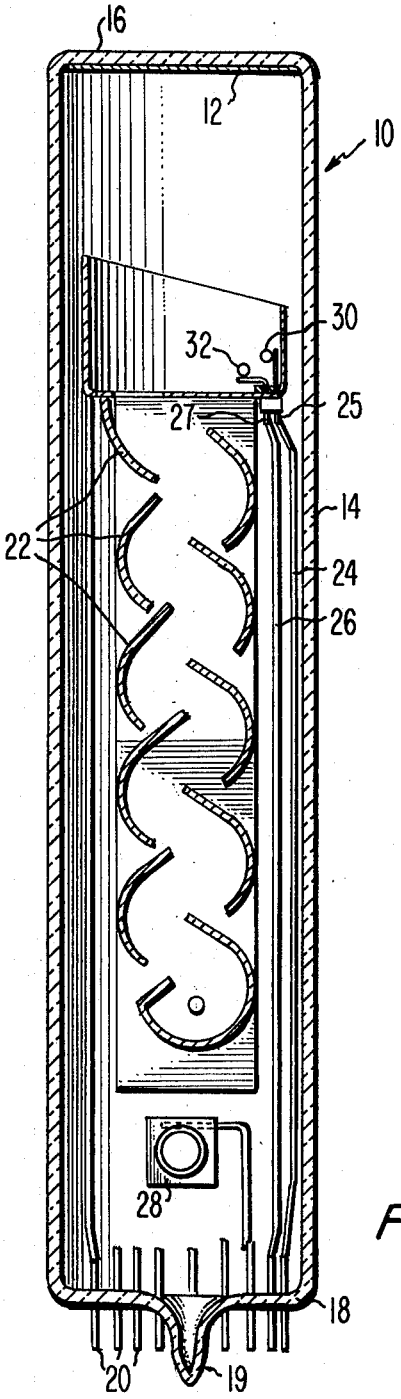
FIG. 1 is a sectional view of a phototube having a photocathode formed in accordance with the present method.

In FIG. 1 of the drawing, there is shown a photomultiplier tube 10 comprising a photoemissive cathode 12 made in accordance with the present novel method. The photomultiplier tube 10 is utilized herein by way of example, it being understood that any photosensitive device incorporating a photocathode may be used.

The tube 10 has a tubular glass envelope 14. One end of the envelope 14 is closed by a substantially flat transparent glass faceplate 16, and the other end of the envelope 14 is closed by a glass stem 18 having a number of electrical lead-in pins 20 and an exhaust tubulation 19, shown as being "tipped off". Along the interior of the tube 10 are spaced a series of dynodes 22.

Mounted near the dynodes 22 are nickel wires 24 and 26 and a container 28. The nickel wires 24 and 26 are connected to, preferably, a tungsten wire filament 25 and a platinum-clad molybdenum wire filament 27, respectively. Attached to the tungsten wire filament 25, as by being fused thereon, and situated near the faceplate 16 is a pellet 30 of pure manganese metal. The pellet 30 may be commercial electrolytic manganese consisting of pure manganese containing a maximum of 0.1% of sulfur and iron.

Attached to the platinum-clad molybdenum filament 27 is a pellet 32 of pure antimony. The pellet 32 may be high grade antimony having a composition of substantially 99.88% antimony and traces of iron, sulfur, arsenic and lead. The container 28 contains a substance for evaporating rubidium and cesium. The substance in container 28 is preferably a mixture of rubidium chromate, cesium chromate and silicon. The nickel wires 24 and 26 are suitably connected to electrical current sources (not shown) to pass a current through the pins 20 so that they can be activated separately by electrical resistance heating. The container 28 can be activated by electrical resistance heating or by RF induction heating.

Figure 2:
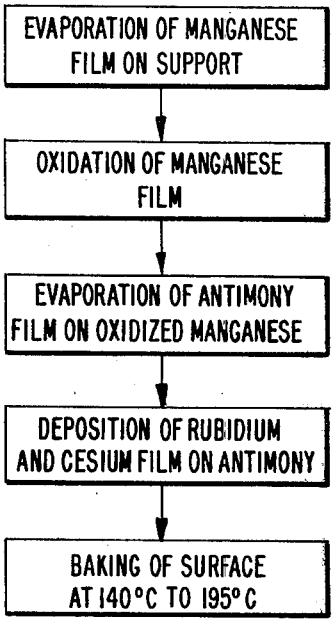
FIG. 2 is a flow chart showing the steps in the formation of the photocathode of FIG. 1 according to one embodiment of the present method.

The photocathode 12 in one example of the present method is made in accordance with the following procedure, which is summarized in the flow chart shown in FIG. 2.

The exhaust tubulation 19 is connected, prior to tipoff, to an exhaust system (not shown) and the tube envelope 14 is evacuated until the pressure in the envelope 14 is in the order of $10^{-6}$ Torr or less. The tube 10 is then baked between 275°–400° C. for two to three hours to remove occluded gases from the interior tube components. The tube 10 is then cooled to room temperature.

While the tube 10 is still being evacuated, a current is passed through the filament 25 as by the current sources (not shown) in order to heat the filament 25 to a temperature sufficiently high to evaporate the manganese from the manganese pellet 30 in the vacuum. The evaporated manganese condenses on the inner portion of the faceplate 16 and forms a thin film thereon. In order to measure the amount of material deposited on the faceplate 16, light transmission can be measured in a manner disclosed in U.S. Pat. No. 2,676,282 to Polkosky. A light indicator can be set to show a scale reading of 100 at full transmission of light through the faceplate 16. The evaporation of manganese is continued until the transmission through the manganese film is preferably between 90–95% of its original value of 100%.

Oxygen is next introduced into the envelope 14 through the exhaust tubulation 19 to a pressure of about 270–370 microns of mercury. The manganese film is then oxidized by the use of a high frequency electrode (not shown) placed over the faceplate 16. The high frequency of the electrode produces within the envelope 14 a gaseous discharge which causes the manganese to react with the oxygen in the envelope 14. The electrode is held over the faceplate for about five to twenty seconds. As a result, the manganese film is fully oxidized. This method of oxidizing metal films within an envelope is well known and completely described in U.S. Pat. No. 2,020,305 to Essig. The oxygen within the envelope is then removed and the light transmission indicator is reset to 100.

A layer of antimony is next deposited over the film of manganese oxide by evaporation of the antimony pellet 32. A current is passed through the filament 27 to heat the filament 27 to a sufficient high temperature to evaporate the pellet 32 of antimony. A film of antimony condenses on the oxidized film of manganese on the faceplate 16. The evaporation of antimony is continued until the light transmission through the faceplate 16 is about 65 to 85% of its value without the evaporated antimony layer.

Rubidium and cesium are then released into the evacuated envelope 14 for activation of the antimony film by heating the container 28 to a sufficiently high temperature to evaporate the substance contained therein. Preferably, the rubidium and cesium are released simultaneously, but the container 28 may be arranged for release of rubidium and cesium alternatively. The container 28 may be heated by passing a current therethrough or by an external RF electrode. Enough rubidium and cesium are released to completely react with the total amount of antimony on the oxidized manganese on the faceplate 16. In order to ensure that all the antimony has been reacted with the rubidium and cesium, an excessive amount of rubidium and cesium is preferably introduced into the envelope 16. The tube 10 is then baked in an oven at a temperature of approximately 140° to 160° C. for about 10 to 20 minutes. The temperature is then increased to about 180° to 195° C. and the tube 10 is heated for about 25 to 50 minutes to promote an activating reaction between the rubidium, cesium and antimony.

The tube 10 is next slowly cooled at a rate of about 5°-10° C. per minute to approximately 70°-80° C. at which temperature the tube is allowed to cool freely to room temperature. After the tube 10 is removed from the exhaust system and the exhaust tubulation 19 sealed, the tube 10 is operative.

In a preferred method of making a Rb-Cs-Sb photocathode, an antimony oxide is utilized as a base film instead of the manganese oxide. It has been previously determined, however, that an antimony film evaporated from a source of pure antimony is not readily oxidized upon the performance of the above-described oxidizing steps. Hence, the use of the manganese film. However, an antimony film may be readily oxidized when the film is evaporated from an antimony-platinum source. Thus, in accordance with the preferred method of making Rb-Cs-Sb photocathode, the pellet 32 is an antimony-platinum alloy comprising about 50% antimony and about 50% platinum, by weight. The pellet 32 is arranged to be situated near the faceplate and the manganese pellet 30 is eliminated. The steps for forming the photocathode are the same as described above with the exception that an antimony film is initially evaporated on the faceplate 16 instead of manganese. Also, the deposition of antimony on the oxidized film is from the same antimony-alloy pellet 32.

Photocathodes made in accordance with the described method and in particular with the antimony oxide film have been measured to have sensitivities consistently within the range of 80 to 130 microamperes per lumen without superficial oxidation. It is also believed that the photocathodes formed by the present method are in substantially stoichiometric proportions according to the formula $Rb_xCs_{3-x}Sb$ and that the well-defined composition accounts for the consistency in its properties.

What is claimed is:

1. A method of forming a photosensitive cathode in an enclosure, comprising:

evacuating said enclosure;

condensing a film of material selected from the group consisting of manganese and antimony onto a substrate in said enclosure;

continuing the condensation of said film until the light transmission through said substrate is reduced to about 90-95% of the transmission prior to the condensing step;

introducing oxygen into said enclosure;

oxidizing said film of material;

depositing a layer of antimony onto said oxidized film;

continuing the deposition of antimony until the light transmission through the substrate is reduced to about 65 to 85% of the transmission prior to the deposition of antimony;

simultaneously evaporating rubidium and cesium from a source and releasing said materials into said enclosure to react with said layer of antimony;

heating said substrate first at a temperature of between 140° to 160° C. for about 10-20 minutes and then at a temperature between 180° to 195° C. for about 25-50 minutes;

slowly cooling said substrate at a rate of about 5°-10° C. per minute to a temperature of approximately 70°-80° C.; and cooling freely said substrate to room temperature.

2. A method of forming a photosensitive cathode on a transparent interior surface of an envelope comprising the steps of:

evacuating said envelope;

baking said envelope at an elevated temperature for an extended period of time;

cooling said envelope to room temperature;

condensing a film of material selected from the group consisting of manganese and antimony onto said surface until the light transmission through said surface is reduced to about 90-95% of the transmission prior to the condensing step;

introducing oxygen into said envelope;

oxidizing said film of material;

removing the residual oxygen from said envelope;

depositing a layer of antimony onto said oxidized film until the light transmission through said surface is reduced to about 65 to 85% of the transmission prior to the deposition of antimony;

evaporating rubidium and cesium from a source and releasing said materials into said envelope to react with said layer of antimony;

heating said envelope to a temperature less than said elevated temperature to promote an activating reaction between said rubidium, cesium and said layer of antimony;

slowing cooling said envelope to a moderate temperature; and freely cooling said envelope to room temperature.

* * * * *